US009055790B2

(12) United States Patent
Tanaka et al.

(10) Patent No.: US 9,055,790 B2
(45) Date of Patent: Jun. 16, 2015

(54) SLIDE FASTENER

(75) Inventors: Ryo Tanaka, Toyama (JP); Yutaka Tominaga, Toyama (JP); Masamichi Hasegawa, Toyama (JP); Ryo Mikuma, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/128,724

(22) PCT Filed: Jan. 27, 2012

(86) PCT No.: PCT/JP2012/051841

§ 371 (c)(1),
(2), (4) Date: Dec. 23, 2013

(87) PCT Pub. No.: WO2012/176486

PCT Pub. Date: Dec. 27, 2012

(65) Prior Publication Data

US 2014/0137375 A1 May 22, 2014

(30) Foreign Application Priority Data

Jun. 24, 2011 (WO) ..... PCT/JP2011/064557

(51) Int. Cl.
*A44B 19/32* (2006.01)
*A44B 19/36* (2006.01)

(52) U.S. Cl.
CPC ..... *A44B 19/32* (2013.01); *Y10T 24/2514* (2015.01); *Y10T 24/2593* (2015.01); *Y10T 24/2539* (2015.01); *A44B 19/36* (2013.01)

(58) Field of Classification Search
CPC ..... A44B 19/32; A44B 19/36
USPC ..... 23/384, 389, 403, 405, 432, 433, 434, 23/435, 436
See application file for complete search history.

(56) References Cited

U.S. PATENT DOCUMENTS 2,274,722 A * 3/1942 Marinsky ..... 156/66
2,515,376 A * 7/1950 Krupp ..... 24/388

(Continued)

FOREIGN PATENT DOCUMENTS

CN 101023823 A 8/2007
CN 102058206 A 5/2011

(Continued)

OTHER PUBLICATIONS

International Search Report, PCT Application No. PCT/JP2012/051841, mailed Feb. 21, 2012.

(Continued)

*Primary Examiner* — Robert J Sandy
*Assistant Examiner* — Louis Mercado
(74) *Attorney, Agent, or Firm* — Kilpatrick Townsend & Stockton LLP

(57) ABSTRACT

A slide fastener having a waterproof structure, and having a pair of left and right fastener stringers including a pair of left and right waterproof fastener tapes and a pair of left and right fastener element rows having a plurality of fastener elements along the side ends of the fastener tapes opposite to each other; a slider for engaging and disengaging the left and right fastener elements with and from each other; and a bottom stopper which is formed over the left and right fastener tapes at lower ends of the fastener elements. The bottom stopper covers a first fastener element near the lowest end except an upper portion of its engaging head and a lower portion of the base of the second fastener element adjacent upward to the first fastener element.

8 Claims, 8 Drawing Sheets

(56) References Cited

U.S. PATENT DOCUMENTS

| | | | | |
|---|---|---|---|---|
| 4,780,937 | A * | 11/1988 | Kusayama | 24/389 |
| 7,082,648 | B2 * | 8/2006 | Morioka et al. | 24/389 |
| D643,778 | S * | 8/2011 | Hasegawa et al. | D11/221 |
| D648,246 | S * | 11/2011 | Hasegawa et al. | D11/221 |
| 2008/0196219 | A1 * | 8/2008 | Holloway et al. | 24/436 |
| 2011/0113596 | A1 | 5/2011 | Williams et al. | |
| 2014/0033483 | A1 * | 2/2014 | Tanaka | 24/403 |
| 2015/0000087 | A1 * | 1/2015 | Tanaka et al. | 24/389 |

FOREIGN PATENT DOCUMENTS

| | | | |
|---|---|---|---|
| EP | 0522366 | A1 | 1/1993 |
| EP | 2324726 | A2 | 5/2011 |
| JP | 49-105308 | A | 9/1974 |
| JP | 02-107309 | U | 8/1990 |
| JP | H05-1307 | | 1/1993 |
| JP | 2007-167220 | A | 7/2007 |
| JP | 2007-215819 | A | 8/2007 |
| JP | 2011-104371 | A | 6/2011 |

OTHER PUBLICATIONS

Office Action, Japanese Patent Application No. 2013-521479, mailed Jul. 15, 2014.

International Preliminary Report on Patentability, PCT Application No. PCT/JP2012/051841, mailed Dec. 24, 2013.

* cited by examiner

SLIDE FASTENER

This application is a national stage application of PCT/JP2012/051841, which claims priority to PCT/JP2011/064557, both of which are incorporated herein by reference.

BACKGROUND OF THE INVENTION

The present invention relates to a slide fastener and more particularly to a waterproof slide fastener.

A waterproof slide fastener including a pair of left and right fastener stringers is known. The fastener stringers comprise a pair of left and right waterproof slide tapes and a plurality of fastener elements, which are formed by injection-molding synthetic resin material on the side ends of the slide tapes opposite to each other. Between the left and right fastener stringers, a slider is slidably inserted for engaging and disengaging the left and right elements with and from each other. Further, the slide fastener is constructed such that a bottom stopper and a top stopper are provided to the lower end and the upper end of the fastener elements, respectively, by synthetic resin material. The technique to injection-mold a bottom stopper using synthetic resin is disclosed in JP,H02-107309,U etc. In such a slide fastener, each of the fastener elements includes an engaging head, a base, a neck for connecting between the engaging head and the base, and a pair of shoulders which extend from both sides of the head in the shape of wing pieces. Each engaging head has two front and rear protrusions which protrude from the opposite side end of a fastener tape. Then, by engaging the left and right fastener elements vertically adjacent to each other using the slider, a shoulder of one of the fastener elements is fitted between the two front and rear protrusions (into a fitting groove in the above JP,H02-107309,U) of the other fastener element. In addition, the opposite faces of the left and right fastener tapes are brought into tight contact with each other. Thereby, the left and right fastener stringers are sealed fluid-tight between them, bringing about the waterproof property.

However, since there is no fastener element in a region between the lowest fastener element and the bottom stopper, a force of fastener elements engaging with each other is not generated. Therefore, in the region, a contacting force between the left and right fastener tapes is weak as compared with that in a region where the fastener elements are engaged with each other. For this reason, when a water pressure or the like is applied, there is a case that water or the like can leak from the region between the lowest fastener element and the bottom stopper. To prevent such water leakage, JP,2007-215819,A discloses a technique in which the region between the lowest fastener element and the bottom stopper is sealed with a waterproof sheet member. As another means, a technique is known that when the bottom stopper is injection-molded, one or more lower fastener elements are covered so as to improve the waterproof property around the bottom stopper.

[Patent Document 1] JP,H02-107309,U

[Patent Document 2] JP,2007-215819,A

However, in the slide fastener described in the patent document 2, there is a case that the sheet member comes off because of long period use. On the other hand, in a method to cover lower fastener elements with the bottom stopper, there is a case that a molten resin leaks upward from a die through a gap between the two front and rear protrusions of the engaging head of a fastener element because of the pressure at injection molding. Such a leakage can cause burrs and make the production of a slide fastener difficult. Further, leaked resin can disturb the engagement and disengagement between lower fastener elements. To completely prevent a leakage from a die as the bottom stopper is injection-molded, the die must be produced with very high precision. In this case, the production cost of a slide fastener becomes excessively high.

In view of the foregoing problems, the invention provides a slide fastener that can improve the waterproof property near the bottom stopper cost-effectively.

SUMMARY OF THE INVENTION

In order to solve the foregoing problems, according to one aspect of the invention, there is provided a slide fastener having a waterproof structure, comprising: a pair of left and right fastener stringers, each of the fastener stringers including a pair of left and right waterproof fastener tapes and a pair of left and right fastener element rows having a plurality of fastener elements along the side ends of the fastener tapes opposite to each other; a slider for engaging and disengaging the left and right fastener elements with and from each other; and a bottom stopper which is formed over the left and right fastener tapes at lower ends of the rows of the fastener elements, wherein each of the fastener elements includes an engaging head, a base, a neck for connecting between the engaging head and the base, and a pair of shoulders which extend from both sides of the neck in the shape of wing pieces, wherein said bottom stopper covers at least an entire lower half of a first fastener element which is the fastener element at the lowest end or near the lowest end of one of the fastener element rows, and also covers at least a portion of a second fastener element which is the fastener element adjacent upward to the first fastener element, the first fastener element being of one of the left and right fastener element rows and the second fastener element being of the other one of the fastener element rows, and wherein said bottom stopper includes a depression depressed downward in the upper side of the bottom stopper.

In the invention, since the bottom stopper covers at least an entire lower half of the first fastener element at the lowest end or near the lowest end and at least a portion of the second fastener element adjacent upward to the first fastener element, the first fastener element and the second fastener element are fixed in the engaged condition by the bottom stopper, which can keep fluid-tight between the first and second fastener elements. Also, in the invention, a depression or a concave portion which is depressed or concaved downward from the upper side of the bottom stopper is provided. Therefore, even if there is a slight run-out from the die for injection-molding the bottom stopper, the run-out can stay within the depression, not having bad influence on the production of the slide fastener.

The bottom stopper can be formed by injection-molding, for example, thermoplastic resin such as polyacetal, polyamide, polypropylene, polybutylene terephthalate, nylon, polycarbonate and the like, or thermoplastic elastomer such as polyurethane group, polyester group, polyamide group or vinyl chloride group. The fastener elements can be formed by injection-molding, for example, thermoplastic resin such as polyacetal, polyamide, polypropylene, polybutylene terephthalate, nylon, polycarbonate and the like.

In the invention, at least a portion of the upper shoulder of the first fastener element may be placed in the depression. By forming the depression of the bottom stopper such that at least a portion of the upper shoulder of the first fastener element lies in the depression, a run-out from the die for molding the bottom stopper can be made stay within the depression.

In an embodiment of the invention, the bottom stopper covers the first fastener element except an upper portion of the engaging head of the first fastener element and also covers a lower portion of the base of the second fastener element, and the upper portion of the engaging head of the first fastener element and a lower portion of the engaging head and neck of the second fastener element are placed in the depression. In this case, the portion of the first fastener element except the upper portion of the engaging head and the lower portion of the base of the second fastener element can be within the coverage of the bottom stopper. Also, since in the depression the upper portion of the engaging head of the first fastener element and the lower portion of the engaging head and neck of the second fastener element are engaged with each other, the fluid-tight property between them can be kept.

In an embodiment of the invention, the bottom stopper covers the first fastener element except at least a portion of the upper shoulder and also covers an entire lower half of the second fastener element. In this case, a portion except at least a portion of the upper shoulder of the first fastener element and the entire lower half of the second fastener element can be within the coverage of the bottom stopper.

In the slide fastener according to an embodiment of the invention, in the depression, a connecting part for connecting between an upper portion of the engaging head of the first fastener element and a lower portion of the engaging head and neck of the second fastener element is provided, and the connecting part is made of the same material as the bottom stopper. Thereby, a space between the upper portion of the engaging head of the first fastener element and the lower portion of the engaging head and neck of the second fastener element is filled with the connecting part. Thus, the fluid-tight property between them is further improved.

In the slide fastener according to the invention, in one embodiment, the connecting part extends from the engaging head of the first fastener element to the upper shoulder of the first fastener element. Also, the bottom stopper completely covers at least one fastener element that is present lower than the first fastener element.

In the invention, by providing the depression depressed from the upper side of the bottom stopper, it would be possible to reduce the amount of a run-out flowing in the direction of the row of the fastener elements from the die for molding the bottom stopper, not having bad influence on the production of the slide fastener. Also, since the amount of a run-out is small, the run-out can stay within the depression. Therefore, a high-precision and high-cost die is not needed. In addition, since the upper portion of the engaging head of the first fastener element and the lower portion of the engaging head and neck of the second fastener element are fixed in the engaged condition in the bottom stopper, the fluid-tight property between them can be kept. Hence, the waterproof property near the bottom stopper can be improved in a cost-effective manner.

Further, by providing the connecting part made of the same material as the bottom stopper in the depression to connect between the upper portion of the engaging head of the first fastener element and the lower portion of the engaging head and neck of the second fastener element, a space between the upper portion of the engaging head of the first fastener element and the lower portion of the engaging head and neck of the second fastener element is filled with the connecting part. Thus, the fluid-tight property between them is further improved.

DETAILED DESCRIPTION OF THE INVENTION

Embodiments of the invention will be described with reference to the drawings. In the following description as to the drawings, the same or similar reference number is assigned to the same or similar part. The following embodiments merely exemplify configurations to embody the technical idea of the invention. Therefore, a concrete configuration of the technical idea of the invention is not limited to the following embodiments.

Figure 1:
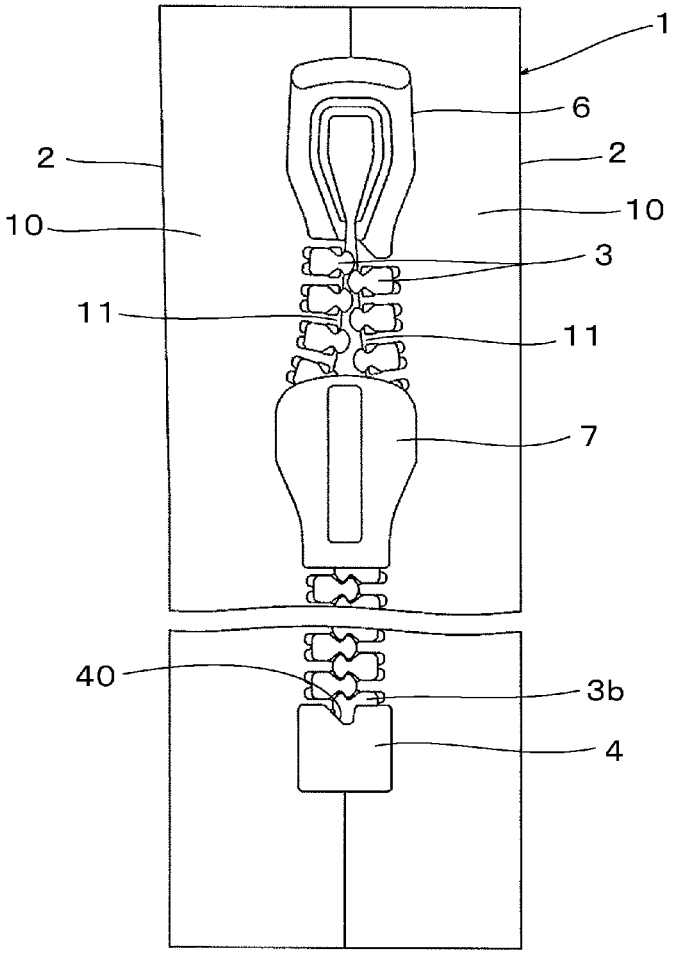
FIG. 1 is an illustrative plan view that shows an example of the entire configuration of a slide fastener, as cut in the longitudinal direction (the up-and-down direction on this paper), according to an embodiment of the invention.

FIG. 1 is an illustrative plan view that shows an example of the entire configuration of a slide fastener 1, as cut in the longitudinal direction (the up-and-down direction on this paper), according to an embodiment of the invention. As shown in FIG. 1, the slide fastener 1 comprises: fastener stringers 2 including left and right fastener tapes 10, 10 and a plurality of fastener elements 3 arranged in a row along an opposite edges 11, 11 of the fastener tapes 10, 10, respectively; and a slider 7 for engaging and disengaging the left and right fastener elements 3 with and from each other. At lower ends of the rows of the fastener elements 3, a bottom stopper 4 is formed over the left and right fastener tapes 10, 10. At the upper ends of the rows of the fastener elements 3, a top stopper 6 is provided. In FIG. 1, the left and right fastener elements 3 located lower than the slider 7 are engaged with each other, and the left and right fastener elements 3 located higher than the slider 7 are not engaged (or separated). In the following explanations, unless stated otherwise, the longitudinal direction (the up-and down direction on the paper of FIG. 1) of the fastener tape 10 is defined as "the (tape) up-and-down direction." In particular, the direction in which the slider 7 is relatively moved with respect to the rows of the fastener elements 3 in order to engage the rows of the fastener elements 3 is defined as "upward," and the direction in which the slider 7 is moved in order to separate the rows of the fastener elements 3 is defined as "downward." Also, the direction which is along the front and rear surfaces of the fastener tapes 10 and perpendicular to the up-and-down direction is defined as "the (tape) width direction" or "the left-and-right direction."

Figure 2:
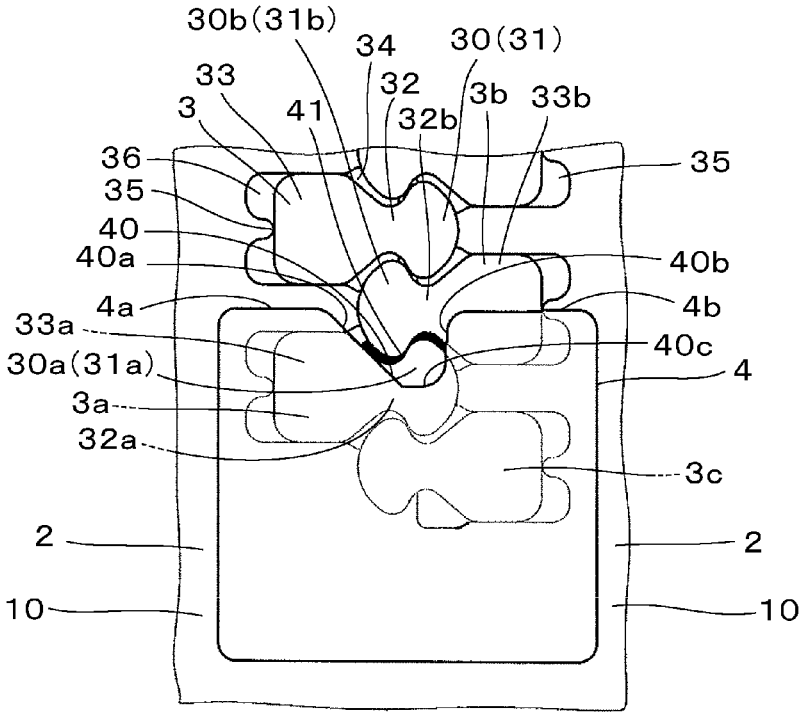
FIG. 2 is an enlarged explanation view that partially transparently shows a part near the periphery of the bottom stopper.
Figure 3:
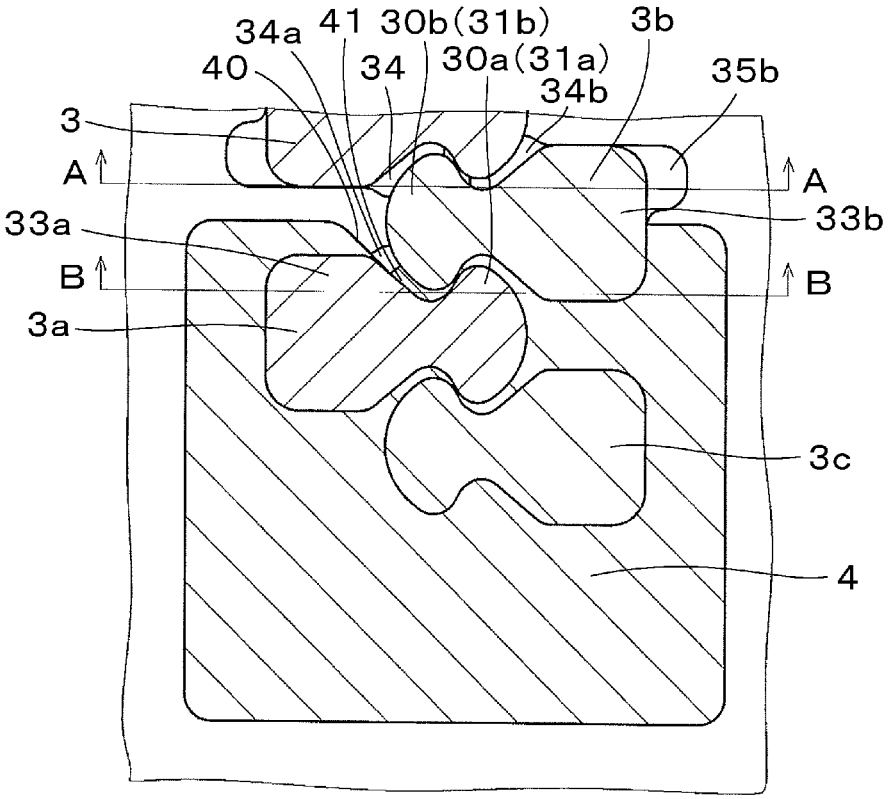
FIG. 3 is a horizontal cross-section explanation view near the periphery of the bottom stopper.
Figure 4:
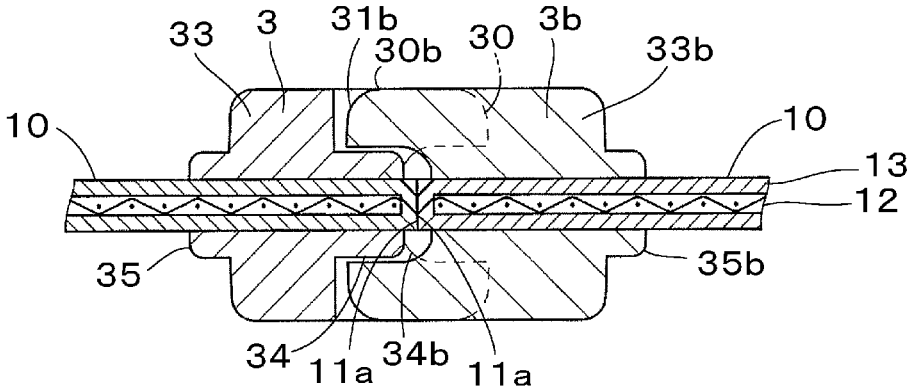
FIG. 4 is a cross-sectional view taken along A-A line in FIG. 3.

FIG. 2 is an enlarged explanation view that partially transparently shows a part near the periphery of the bottom stopper 4 in the slide fastener 1. FIG. 3 is a horizontal cross-section explanation view near the periphery of the bottom stopper 4. Further, FIG. 4 is a cross-sectional view taken along A-A line in FIG. 3. In FIG. 4, although the reference numbers of the fastener elements 3, 3*b* are assigned only to one surface of the front and rear surfaces of the fastener tape 10, the portions of the same reference numbers exist on the other surface as well (The same is true of the reference numbers of the fastener elements 3*a*, 3*b* and the bottom stopper 4 in FIG. 5). The fastener tape 10 comprises a waterproof structure. As the fastener tape 10, for example, a waterproof tape is preferably used in which the periphery of a woven or knitted strip member 12 (see FIG. 4) is covered with a waterproof layer 13 made of elastomer material of natural or synthetic rubber or various synthetic resins. The waterproof layer 13 may be made of thermoplastic elastomer of, for example, polyurethane group, polyester group, polyamide group or vinyl chloride group. In this embodiment, "the waterproof structure" means the structure where end surfaces 11*a* of the fastener elements 3 are in tight contact with each other as shown in FIG. 4 in the state of the fastener elements 3 being engaged with each other, and the left and right fastener tapes 10, 10 are sealed fluid-tight with no gap between them. In the fastener tape 10, since the periphery of the strip member 12 is covered with the waterproof layer 13, by bringing the end surfaces of the waterproof layers 13 into tight contact with each other, the waterproof property or the fluid-tight property between the left and right fastener tapes 10, 10 can be obtained. The airtight property can also be obtained. The waterproof layer may be formed only on one side of the strip member.

Each fastener element 3 is formed by injection-molding synthetic resin such as thermoplastic resin and the like on the front and rear surfaces of the fastener tape 10 in the same shape on both sides. Although not shown in the drawings, in the fastener tape 10, there are formed through-holes along its opposite edge 11 to allow a molten resin to flow through the holes as the fastener elements 3 is being produced. Each of the holes has an enough size for a molten resin to flow through it. Also, the holes are provided at each location of the fastener elements 3 in a one-by-one manner. Thereby, the respective fastener elements 3 are fused and spliced integrally onto the front and rear surfaces of the fastener tapes 10 via the through-holes. The bottom stopper 4 as described later is also formed on the front and rear surfaces of the fastener tapes 10 through through-holes (not shown) of the fastener tapes 10 by injection-molding thermoplastic resin and the like. This injection molding is carried out after the formation of the fastener elements 3. With reference to FIGS. 2 to 4, each of the fastener elements 3 (3*a*, 3*b*) comprises: an engaging head 30 having an approximately oval shape long in the tape up-and-down direction from a planar viewpoint; a neck 32 extending from the engaging head 30 in the tape width direction while narrowing in the tape up-and-down direction; and a base 33 further expanding in the tape up-and-down direction from the neck 32 and further extending in the width direction. On both up-and-down sides of the neck 32, a pair of shoulders 34 (see FIG. 6) are formed. Each of the shoulders 34 extends in the tape up-and-down direction and has the shape of a wing piece. As can be seen from FIG. 4, the height of each shoulder 34 from the front or rear surface of the fastener tape 10 is thinned to about ⅓ to ¼ that of the engaging head 30, neck 32 and base 33. The engaging head 30 of one fastener element 3 includes two front and rear protrusions 31 (corresponding to protrusions 31*b* in FIG. 4) which protrude in the tape width direction from the end surface 11*a* of the fastener tape 10 toward the other fastener tape 10. Between the two protrusions 31, the opposite edge 11 of the other side fastener tape 10 and shoulders 34 of the other side fastener elements 3 adjacent to the one fastener element 3 in the up-and down direction are fitted in the engaged condition. Thereby, even if a water pressure or the like is applied from the front or rear surface of the fastener stringers 2, 2, the fastener elements 3, 3 engaged with each other will not be disengaged, and the tight contact condition between the end surfaces 11*a*, 11*a* of the fastener tapes 10, 10 can be maintained. The fastener element 3 further includes two legs 36 on the side opposite to the engaging head 30. The legs 36 are forked from the base 33 through a crotch 35. The thickness of the leg 36 from the front or rear surface of the fastener tape 10 is equal to that of the shoulder 34. With the two legs 36 provided, the slider 7 shown in FIG. 1 can contact the legs 36 as it slides in the row direction of the fastener elements 3, and thereby the sliding operation can be made light. The engaging head 30 and neck 32 of one fastener element 3 (3*a*, 3*b*) has an upper part to be engaged with the opposite fastener element adjacent upward to the one fastener element and a lower part to be engaged with the opposite fastener element adjacent downward to the one fastener element. The base 33 and shoulder 34 have an upper part and a lower part in the tape up-and-down direction as well.

The bottom stopper 4 is formed by injection-molding thermoplastic resin or the like inside a cavity of a die not shown and to the fastener stringers 2 after the formation of the rows of the fastener elements 3. The bottom stopper 4 is made both on the front and rear surfaces of the left and right fastener tapes 10 in the same shape on both sides. The bottom stopper 4 in this embodiment covers completely the lowest fastener element 3*c* in the row of the fastener elements 3 in the engaged condition, as shown in FIGS. 2 and 3. It also covers a first fastener element 3*a* that is the second lowest fastener element except an upper half portion of the engaging head 30*a*, and further covers a lower half portion of the base 33 of the second fastener element 3*b* that is the third lowest fastener element. Although the bottom stopper 4 is approximately rectangular (approximately square) from a planar viewpoint, it has a depression 40 which is depressed downward between left and right upper sides 4*a*, 4*b*. That is, the bottom stopper 4 has the depression 40 that is recessed downward in the middle of the upper side of the bottom stopper 4 in the tape width direction. The upper sides 4*a*, 4*b* exist on both left and right sides of the depression 40. Since the bottom stopper is molded so as to completely cover the lowest fastener element 3*c*, and the lowest fastener element 3*c* and the first element 3*a* are engaged with each other, it is possible to keep the fastener tapes in tight contact with each other due to the engagement between the first element 3*a* and the second element 3*b*. Hence, it is easier to exhibit the fluid-tight property. The first fastener element 3*a* is hereinafter referred to as "the first element 3*a*," and the second fastener element 3*b* is referred to as "the second element 3*b*." Without the depression 40 in the bottom stopper 4 and with a straightly successive upper side in the depression 40, a leakage or a run-out from the molding die would arise and flow upward through a gap between the two front and rear protrusions 31*b*, 31*b* of the engaging head 30*b* of the second element 3*b*. This might lead to a danger of undetachable connection between the second element 3*b* and the fastener element 3 just above the second element 3*b*. In addition, when a die is produced with very high precision in order to completely prevent such a run-out from a die, there would be a problem that a production cost of the slide fastener 1 becomes excessively expensive. The slide fastener 1 includes a connecting part 41 provided between the engaging head 30*a* and neck 32*a* of the first element 3*a* and the engaging head 30*b* and neck 32*b* of the second element 3*b*, in the depression 40 of the bottom stopper 4. The connecting part 41 is made of the same resin material as the bottom stopper 4. In FIG. 2, the connecting part 41 is conveniently blacked for the sake of clarity. The connecting part 41 may be formed, for example, by intentionally pouring a molten resin into between the engaging head 30*a* and neck 32*a* of the first element 3*a* and the engaging head 30*b* and neck 32*b* of the second element 3*b* from the die for molding the bottom stopper 4 as the bottom stopper 4 is formed.

Figure 5:
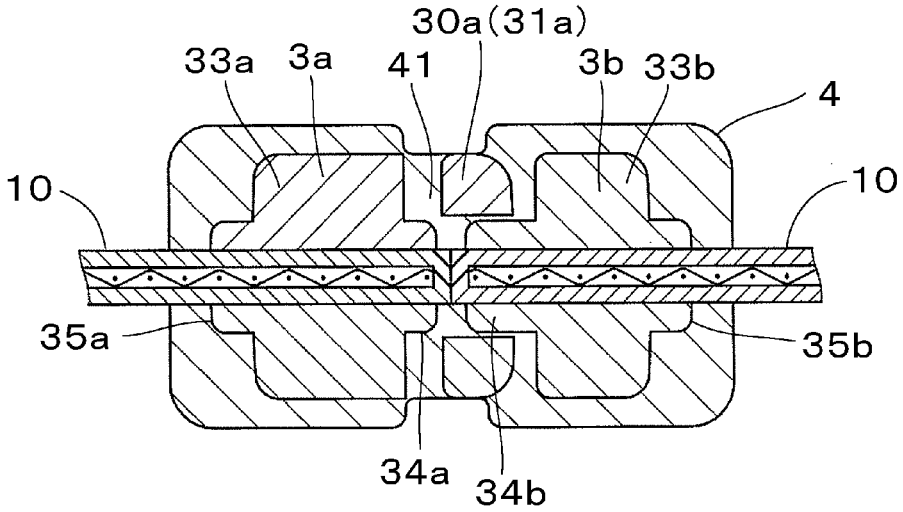
FIG. 5 is a cross-sectional view taken along B-B line in FIG. 3.
Figure 6:
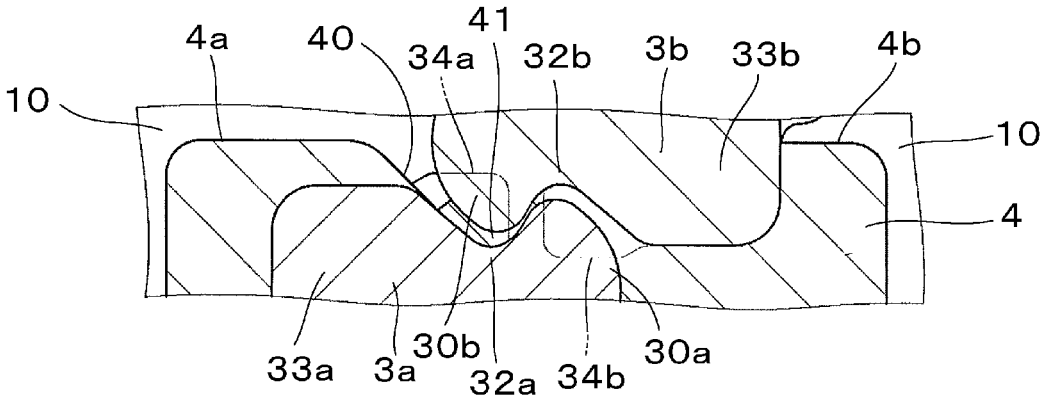
FIG. 6 is a partially enlarged horizontal cross-section explanation view of FIG. 3.

FIG. 5 is a cross-sectional view taken along B-B line in FIG. 3. The outer shape of the cross-section in the width direction of the bottom stopper 4 (the cross-section as shown FIG. 5) is rectangular. The height (thickness) of the bottom stopper 4 from the front and rear surfaces of the fastener tape 10 and the length of the bottom stopper 4 in the tape width direction are greater than those of the first and second elements 3*a*, 3*b*. The height of the connecting part 41 from the front and rear surfaces of the fastener tape 10 is almost equal to that of the first and second elements 3*a*, 3*b*. With reference to FIG. 2 again, the left upper side 4*a* of the bottom stopper 4 is straight in parallel to the width direction (perpendicular to the up-and-down direction). In the tape up-and-down direction, the left upper side 4*a* lies above the base 32*c* of the first element 3*a* and arrives at the middle of the second element 3*b*. The right upper side 4*b* is also straight in parallel to the width direction and, in the up-and-down direction, lies at the level matching with the extension line of the left upper side 4*a* and arrives at the middle of the base 33*b* of the second element 3*b*. The depression 40 of the bottom stopper 4 is defined by: an inclined side 40*a* that is inclined rightward and downward from the right end of the left upper side 4*a*; a vertical side 40*b* that extends downward from the left end of the right upper side 4*b* in substantially parallel to the up-and-down direction; and a bottom side 40*c* that connects the inclined side 40*a* and the vertical side 40*b*. The bottom side 40*c* extends rightward from the lower end of the inclined side 40*a* in substantially parallel to the width direction, and then connects to the lower end of the vertical side 40*b* while curving upward. An upper half of the engaging head 30*a* of the first element 3*a* and respective lower halves of the engaging head 30*b* and the neck 32*b* of the second element 3*b* are within the coverage of the depression 40, namely, the region surrounded with the inclined side 40*a*, the vertical side 40*b* and the bottom side 40*c*, below the extension line of the upper sides 4*a*, 4*b*. As shown in FIG. 6 that is a partially enlarged view of FIG. 3, in the range of the depression 40, the above connecting part 41 is filled between the first element 3*a* and the second element 3*b*. In FIG. 6, the reference numeral 34*a* indicates the tape-upper side shoulder of the first element 3*a*. The shoulder 34*a* is fitted between the front and rear protrusions 31*b* of the engaging head 30*b* of the second element 3*b*. Also, the reference number 34*b* indicates the tape-lower side shoulder of the second element 3*b*. The shoulder 34*b* is fitted between the front and rear protrusions 31*a* of the engaging head 30*a* of the first element 3*a*. The connecting part 41 is made of the same material as the bottom stopper 4. In the depression 40, the connecting part 41 successively extends from the right-side portion of the bottom stopper 4 to between an upper portion of the engaging head 30*a* of the first element 3*a* and a lower portion of the engaging head 30*b* and neck 32*b* of the second element 3*b*. From there, the connecting part 41 further extends to between the head 30*b* of the second element 3*b* and the neck-side portion of the base 33*a* of the first element 3*a* connecting to the surface of the upper shoulder 34*a* of the first element 3*a*. With the connecting part 41, the fluid-tight property between the first and second elements in the depression 40 further improves.

Figure 7:
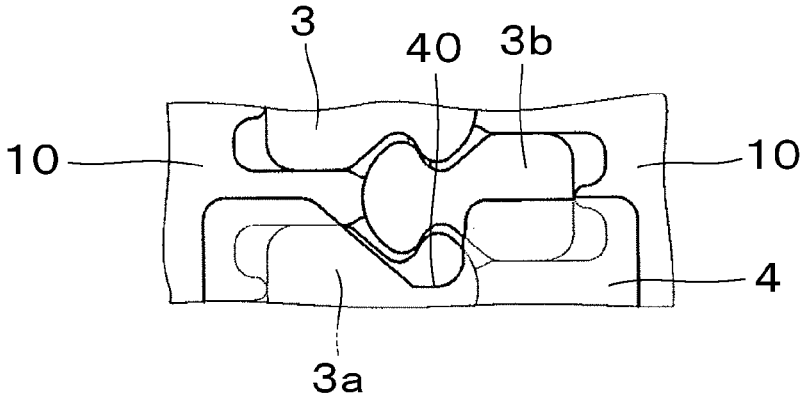
FIG. 7 is a partially enlarged explanation view that shows an example in which a connecting part is not provided between a first fastener element and a second fastener element.
Figure 8:
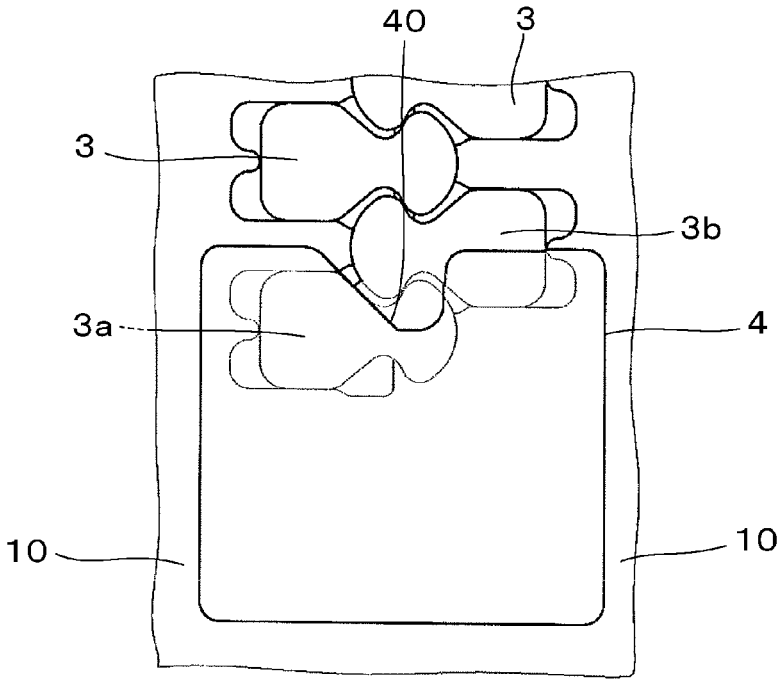
FIG. 8 is a partially enlarged explanation view similar to FIG. 2, which shows an example in which a first fastener element is the lowest fastener element.

FIG. 7 is a partially enlarged explanation view that shows an example in which the connecting part 41 is not provided between the first element 3*a* and the second element 3*b*. Even if the connecting part 41 does not exist between the first and second elements 3*a*, 3*b*, the first and second elements 3*a*, 3*b* are sealed fluid-tight and firmly engaged with each other because the shoulders 34*a*, 34*b* of the first and second element 3*a*, 3*b* are fitted between the two front and rear protrusions 31*b*, 31*a* of the engaging heads 30*b*, 30*a*, respectively. FIG. 8 is a partially enlarged explanation view that shows an example in which the above-stated fastener element 3*c* does not exist in the bottom stopper 4, and therefore the first element 3*a* is the lowest fastener element. Although not shown in the drawings, two or more fastener elements can be completely covered by the bottom stopper 4. In other words, there can be two or more fastener elements lower than the first element 3*a*. In this example, the lowest pair of the left and right fastener elements come in the range of the bottom stopper 4, and its upper sides 4*a*, 4*b* are located above the part where the first element 3*a* and the second element 3*b* are engaged with each other. Therefore, even if a laterally pulling force in the direction to separate the left and right fastener tapes arises, the laterally pulling force will not be directly applied to the engaged part, maintaining the fluid-tight property.

Figure 9:
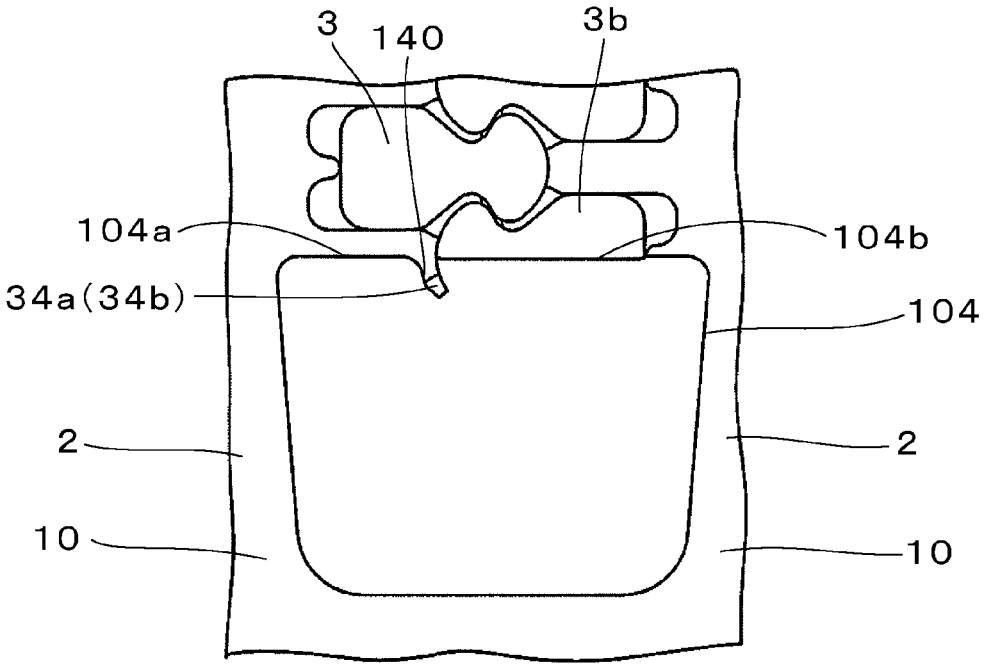
FIG. 9 is an illustrative plan view that shows an example of another bottom stopper.
Figure 10:
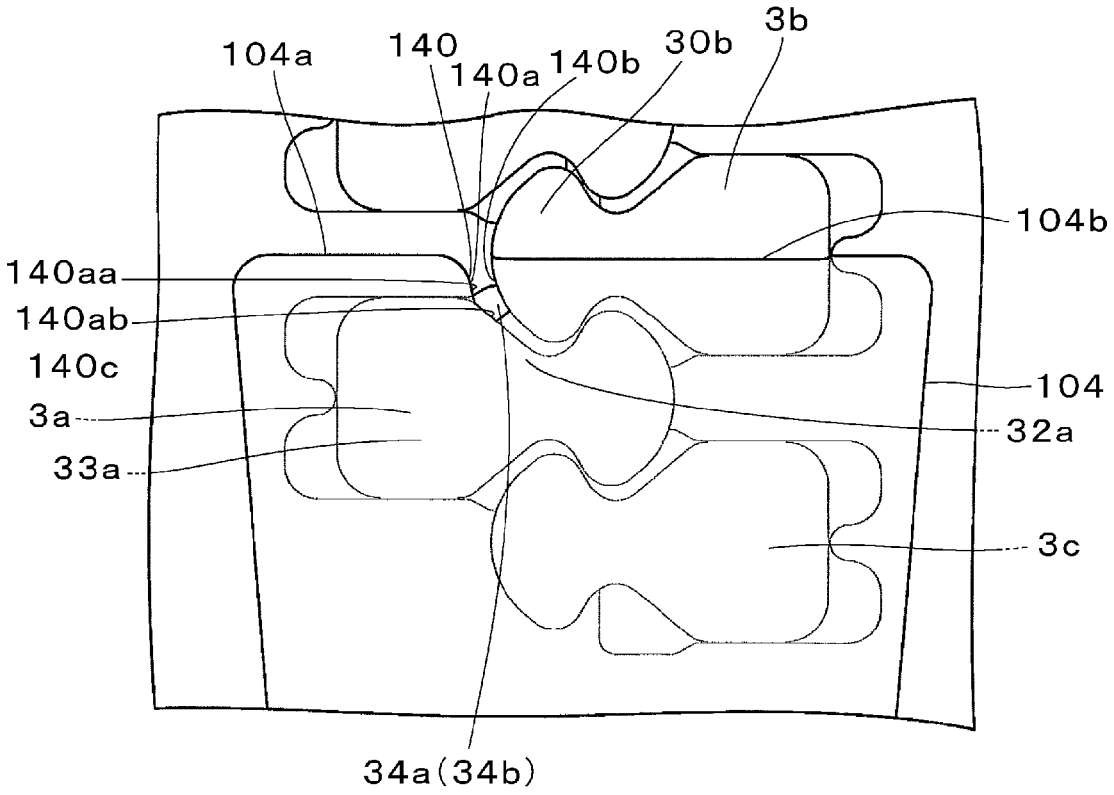
FIG. 10 is an enlarged explanation view that partially transparently shows a part near the periphery of the bottom stopper in FIG. 9.

FIG. 9 is a plan view that shows an example of another bottom stopper. FIG. 10 is an enlarged explanation view that partially transparently shows a part near the periphery of the bottom stopper 104 in FIG. 9. Since the construction other than the bottom stopper 104 is the same as the above-mentioned construction, the same reference numerals are assigned. The bottom stopper 104 in this embodiment completely covers the lowest fastener element 3*c*. Also, it covers the second lowest first fastener element 3*a* except a portion 34*b* of the upper shoulder 34*a* on the base 33*a* side. The bottom stopper 104 further covers an entire lower half of the third lowest second element 3*b*. In other words, the bottom stopper 104 covers a lower half of the second element 3*b* in the entire tape width direction. The bottom stopper 104 has a depression 140, which is depressed downward between left and right upper sides 104*a*, 104*b*. The upper sides 104*a*, 104*b* are parallel to the width direction and at the same level in the up-and-down direction. The part 34*b* of the shoulder 34*a* lies (or exists) in the depression 140. The right upper side 104*b* of the depression 140 terminates at the leftmost end of the engaging head 30*b* of the second element 3*b*. The right end of the left upper side 104*a* is located, in the width direction, at near the boundary between the base 33*a* and the neck 32*a* of the first element 3*a*. The depression 140 is defined by: a right side 140*b* that extends along the contour of the engaging head 30*b* of the second element 3*b* downward from the left end of the right upper side 104*b*; a left side 140*a* that extends downward and rightward while curving from the right end of the left upper side 104*a*; and a bottom side 140*c* that connect between the lower ends of the right and left sides 140*b*, 140*a*. The left side 140*a* includes: a left upper line 140*aa* that extends from the right end of the left upper side 104*a* to near the boundary between the base 33*a* and the neck 32*a* of the first element 3*a*; and a left lower line 140*ab* that extends from the lower end of the left upper line 140*aa* along the contour of the upper neck 32*a* of the first element 3*a*. The angle between the left upper line 140*aa* and the left lower line 140*ab* is an obtuse angle between about 140 and 160 degrees. The bottom side 140*c* is inclined upward and rightward in approximately parallel to the end surface (contour), in the depression 140, of the part 34*b* of the shoulder 34*a*, and is located slightly leftward from the middle, in the width direction, of the upper neck 32*a* of the first element 3*a*. In this embodiment, the depression 140 in the bottom stopper 104 is designed to have the minimum size enough to prevent a run-out from the die for molding the bottom stopper while covering the substantially entire area of the first element 3*a* and the entire area of the lower half of the second element 3*b* to seal fluid-tight between the first and second elements 3*a*, 3*b*. The right upper end side 104*b* of the bottom stopper 104 is made straight so as to pass over the neck 32*b* and the base 33*b* from the leftmost end of the engaging head 30*b* of the third lowest second element 3*b*.

DESCRIPTION OF REFERENCE NUMBERS

1 Slide Fastener
2 Fastener Stringer
3 Fastener Element
3*a* First Fastener Element
3*b* Second Fastener Element
30, 30*a*, 30*b* Engaging Head
31, 31*a*, 31*b* Protrusion
32, 32*a*, 32*b* Neck
33, 33*a*, 33*b* Base
34, 34*a*, 34*b* Shoulder
4, 104 Bottom Stopper
40, 140 Depression
41 Connecting Part

The invention claimed is:

1. A slide fastener having a waterproof structure, comprising:

a pair of left and right fastener stringers including a pair of left and right waterproof fastener tapes and a pair of left and right fastener element rows having a plurality of fastener elements along side ends of the fastener tapes opposite to each other;

a slider for engaging and disengaging the left and right fastener elements with and from each other; and a bottom stopper which is formed over the left and right fastener tapes at lower ends of the rows of the fastener elements, wherein each of the fastener elements includes an engaging head, a base, a neck for connecting between the engaging head and the base, and a pair of shoulders which extend from both sides of the neck in a shape of wing pieces, wherein said bottom stopper covers at least an entire lower half of a first fastener element which is the fastener element at a lowest end or near the lowest end of one of the fastener element rows, and also covers at least a portion of a second fastener element which is the fastener element adjacent upward to the first fastener element, the first fastener element being of one of the left and right fastener element rows and the second fastener element being of another one of the fastener element rows, and wherein said bottom stopper includes a depression depressed downward in an upper side of the bottom stopper.

2. The slide fastener according to claim 1, wherein at least a portion of an upper shoulder of the first fastener element is placed in the depression.

3. The slide fastener according to claim 1, wherein the bottom stopper covers the first fastener element except an upper portion of the engaging head of the first fastener element and also covers a lower portion of the base of the second fastener element, and wherein the upper portion of the engaging head of the first fastener element and a lower portion of the engaging head and neck of the second fastener element are placed in the depression.

4. The slide fastener according to claim 1, wherein the bottom stopper covers the first fastener element except at least a portion of an upper shoulder and also covers an entire lower half of the second fastener element.

5. The slide fastener according to claim 1, wherein in the depression, a connecting part for connecting between an upper portion of the engaging head of the first fastener element and a lower portion of the engaging head and neck of the second fastener element is provided, and the connecting part is made of a same material as the bottom stopper.

6. The slide fastener according to claim 5, wherein the connecting part extends from the engaging head of the first fastener element to an upper shoulder of the first fastener element.

7. The slide fastener according to claim 1, wherein the bottom stopper completely covers at least one fastener element that is present lower than the first fastener element.

8. The slide fastener according to claim 1, wherein the bottom stopper is formed by injection-molding synthetic resin.

* * * * *